US011631943B2

(12) United States Patent
Hsu et al.

(10) Patent No.: US 11,631,943 B2
(45) Date of Patent: Apr. 18, 2023

(54) ANTENNA STRUCTURE AND WIRELESS COMMUNICATION DEVICE USING SAME

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 37 days.

(21) Appl. No.: 17/523,073

(22) Filed: Nov. 10, 2021

(65) Prior Publication Data

US 2022/0166150 A1 May 26, 2022

(30) Foreign Application Priority Data

Nov. 25, 2020 (CN) ..... 202011338097.9

(51) Int. Cl.

| | |
|---|---|
| ***H01Q 21/28*** | (2006.01) |
| ***H01Q 1/24*** | (2006.01) |
| ***H01Q 3/24*** | (2006.01) |
| ***H01Q 5/371*** | (2015.01) |

(52) U.S. Cl.

CPC ..... *H01Q 21/28* (2013.01); *H01Q 1/241* (2013.01); *H01Q 3/24* (2013.01); *H01Q 5/371* (2015.01)

(58) Field of Classification Search

CPC ..... H01Q 21/28; H01Q 5/37; H01Q 1/24; H01Q 3/24

USPC ..... 343/702

See application file for complete search history.

(56) References Cited

U.S. PATENT DOCUMENTS

| | | | | |
|---|---|---|---|---|
| 8,259,015 B2 * | 9/2012 | Wu | ..... | H01Q 5/40 343/702 |
| 2013/0088397 A1 * | 4/2013 | Mo | ..... | H01Q 1/44 343/702 |

FOREIGN PATENT DOCUMENTS

| | | |
|---|---|---|
| CN | 105514604 A | 4/2016 |
| CN | 110380197 A | 10/2019 |
| TW | 201929320 A | 7/2019 |
| TW | 201947814 A | 12/2019 |

* cited by examiner

*Primary Examiner* — Andrea Lindgren Baltzell
(74) *Attorney, Agent, or Firm* — ScienBiziP, P.C.

(57) ABSTRACT

An antenna structure applied in a wireless communication device includes a frame, a first feed portion, a second feed portion, and a ground portion. The frame defines at least a first gap and a second gap. The first gap and the second gap collectively divide the frame into a first radiation portion and a second radiation portion. The first feed portion is electrically connected to the first radiation portion and a first signal feed point for feeding currents and signals to the first radiation portion. The second feed portion is electrically connected to the second radiation portion and a second signal feed point for feeding currents and signals to the second radiation portion. When the first radiation portion and the second radiation portion supply currents, respectively, the first radiation portion and the second radiation portion generate radiation signals in at least one same frequency band.

17 Claims, 13 Drawing Sheets

ANTENNA STRUCTURE AND WIRELESS COMMUNICATION DEVICE USING SAME

FIELD

The subject matter herein generally relates to wireless communications, to an antenna structure and a wireless communication device using the antenna structure.

BACKGROUND

Antennas are for receiving and transmitting wireless signals at different frequencies. However, an antenna structure is complicated and occupies a large space in a wireless communication device, which makes miniaturization of the wireless communication device problematic. Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
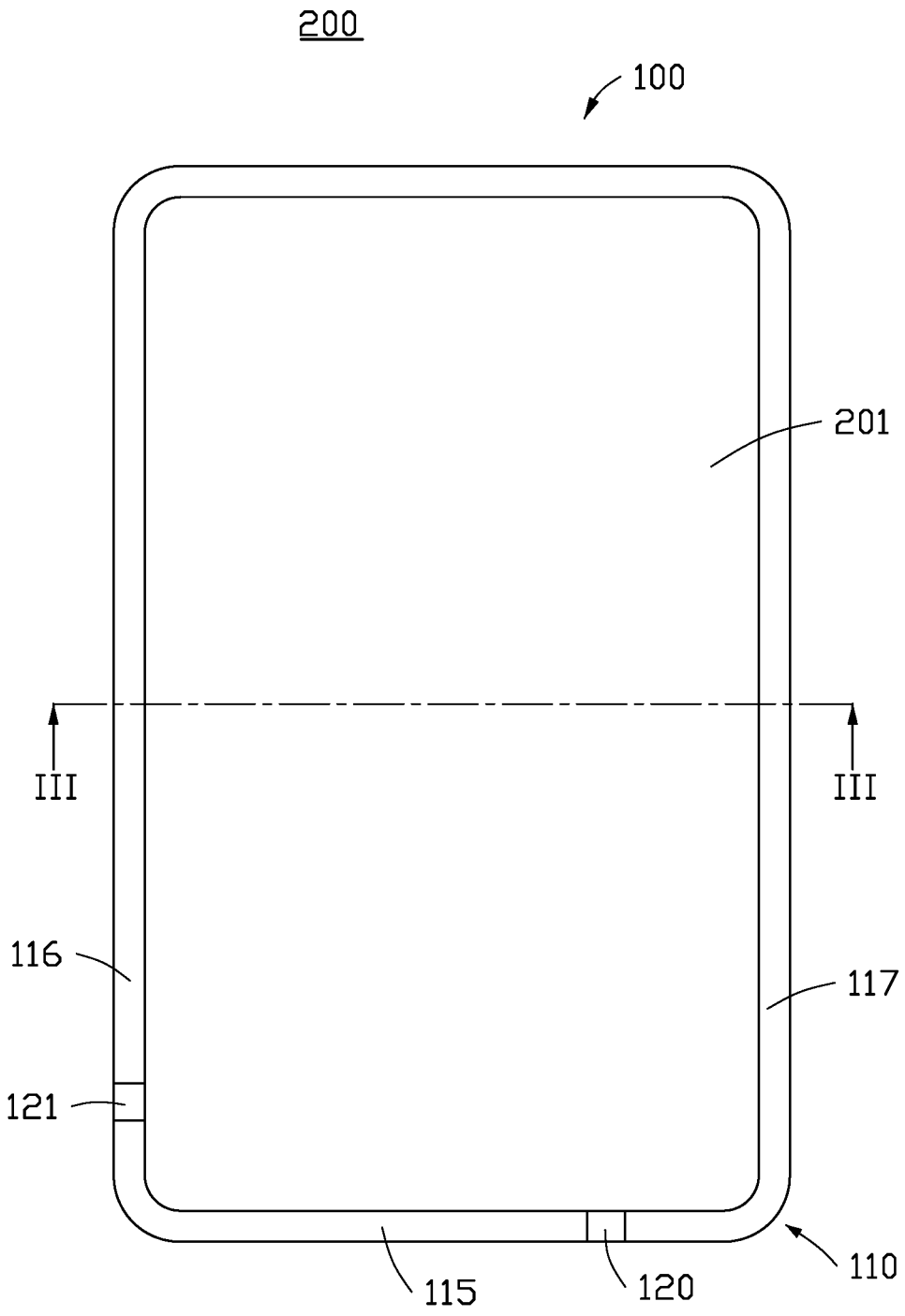
FIG. 1 is a schematic diagram of an embodiment of a wireless communication device including an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection may be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but may have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the same.

Figure 2:
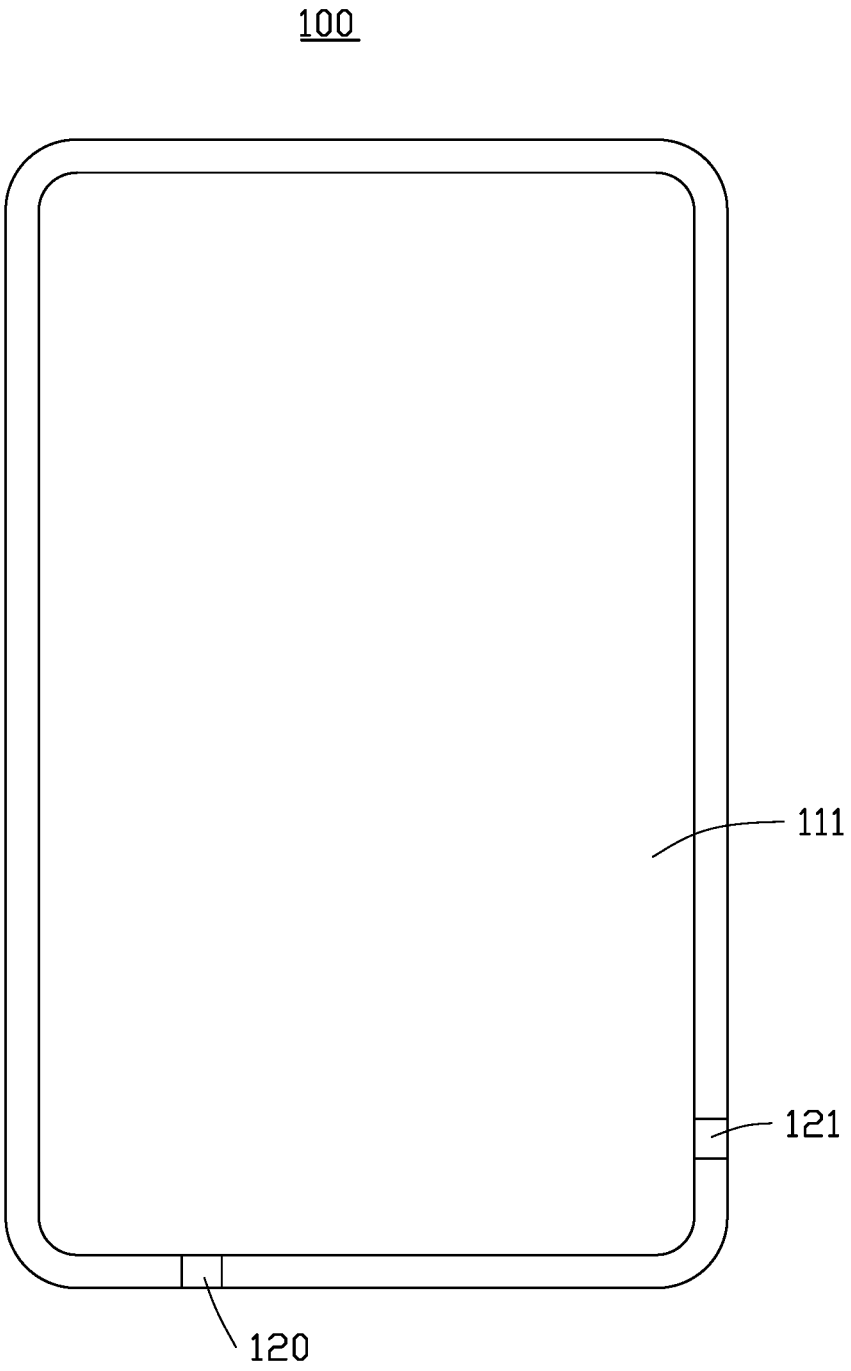
FIG. 2 is a schematic diagram similar to FIG. 1, but is shown from another angle.

FIG. 1 and FIG. 2 illustrate an embodiment of a wireless communication device 200 using an antenna structure 100. The antenna structure 100 may be used in the wireless communication device 200, which may be for example, a mobile phone, a tablet computer, a laptop, a personal digital assistant (PDA), a smart watch, a game machine, or a television. The antenna structure 100 may transmit and receive radio waves, to exchange wireless signals.

The wireless communication device 200 functions in any of the following communication technologies: BLUETOOTH (BT) communication technology, global positioning system (GPS) communication technology, wireless fidelity (WI-FI) communication technology, global system for mobile communication (GSM) technology, wideband code division multiple access (WCDMA) communication technology, long term evolution (LTE) communication technology, 5G communication technology, SUB-6G communication technology, and any other future communication technologies.

Figure 3:
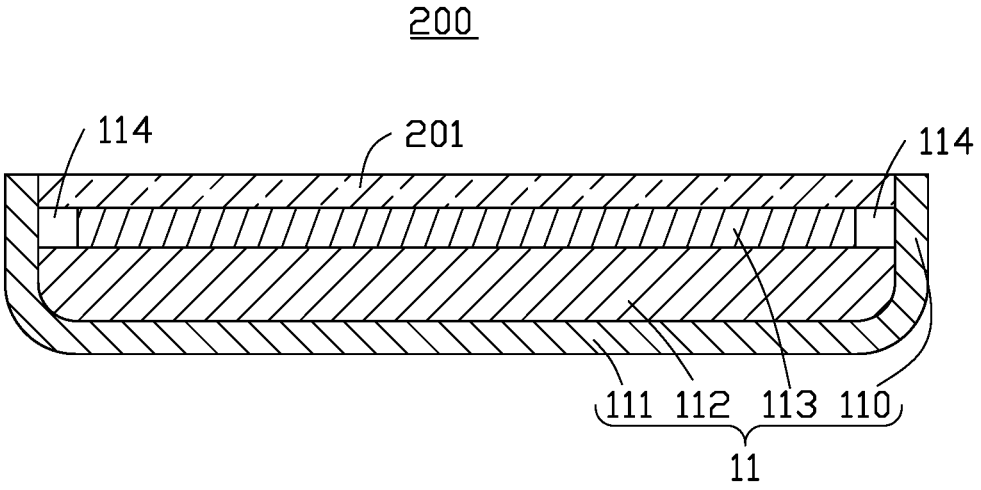
FIG. 3 is a cross-sectional view taken along line of FIG. 1.

Referring to FIG. 3, the wireless communication device 200 includes a housing 11 and a display unit 201. The housing 11 includes at least a frame 110, a back board 111, a ground plane 112, and a middle frame 113.

The frame 110 is substantially a ring structure. The frame 110 may be made of metal or other conductive material. The back board 111 is positioned at a periphery of the frame 110. The back board 111 may be made of metal or other conductive materials. In at least one embodiment, the back board 111 may be an integrated metal piece.

In at least one embodiment, an opening (not shown) is defined on a side of the frame 110 opposite to the back board 111 for receiving the display unit 201. The display unit 201 has a display plane, and the display plane is exposed through the opening. In at least one embodiment, the display unit 201 may be a touch display combining a touch sensor. The touch sensor in the display may be a touch panel or a touch sensitive panel.

In at least one embodiment, the display unit 201 has a high screen-to-body ratio. That is, an area of the display plane of the display unit 201 is greater than 70% of a frontal area of the wireless communication device 200, and even a front full screen may be achieved. In at least one embodiment, a full screen may be achieved with a slot other than the necessary slot defined in the antenna structure 100, and the left, the right, and the lower sides of the display unit 201 may be connected to the frame 110 seamlessly.

The ground plane 112 may be made of metal or other conductive materials, to provide a ground connection for the antenna structure 100. The ground plane 112 may be arranged in a receiving space (not shown) surrounded by the frame 110 and the back board 111.

The middle frame 113 is substantially a rectangular sheet. The middle frame 113 is made of metal or other conductive materials. A shape and size of the middle frame 113 are slightly less than those of the ground plane 112. The middle frame 113 is stacked on the ground plane 112. In at least one embodiment, the middle frame 113 is a metal sheet located between the display unit 201 and the ground plane 112. The middle frame 113 is used to support the display unit 201, provide electromagnetic shielding, and improve the mechanical strength of the wireless communication device 200.

In at least one embodiment, the frame 110, the back board 111, the ground plane 112, and the middle frame 113 form an integral frame. The back board 111, the ground plane 112, and the middle frame 113 may be metal with great proportions, thus forming a system ground plane (not shown) of the antenna structure 100. The system ground plane is positioned so as to be spaced from an edge of one side of the frame 110 and is electrically connected to the frame 110 through at least one connecting point. Such as contacting the frame 110 through elastic pieces, pins, welding, etc. for providing a ground for the antenna structure 100. In at least one embodiment, a distance between the frame 110 and the system ground plane may be adjusted according to requirements. For example, the distance between the frame 110 and the system ground plane at different locations may be a uniform distance or different distances.

In at least one embodiment, a clearance area 114 may be formed between the system ground plane and the frame 110. For instance, in another embodiment, one of the back board 111, the ground plane 112, and the middle frame 113, such as the middle frame 113 and the frame 110 cooperatively form the clearance area 114.

In other embodiments, the wireless communication device 200 may further include one or more electronic elements, such as a processor, a circuit board, a storage, a power assembly, an input/output circuit, an audio assembly (such as a microphone and/or a speaker), a multi-media assembly (such as a front camera and/or a rear camera), and a sensor assembly (such as a proximity sensor, a range sensor, an ambient light sensor, an acceleration sensor, a gyroscope, a magnetic sensor, a pressure sensor, and/or a temperature sensor), etc.

Figure 4:
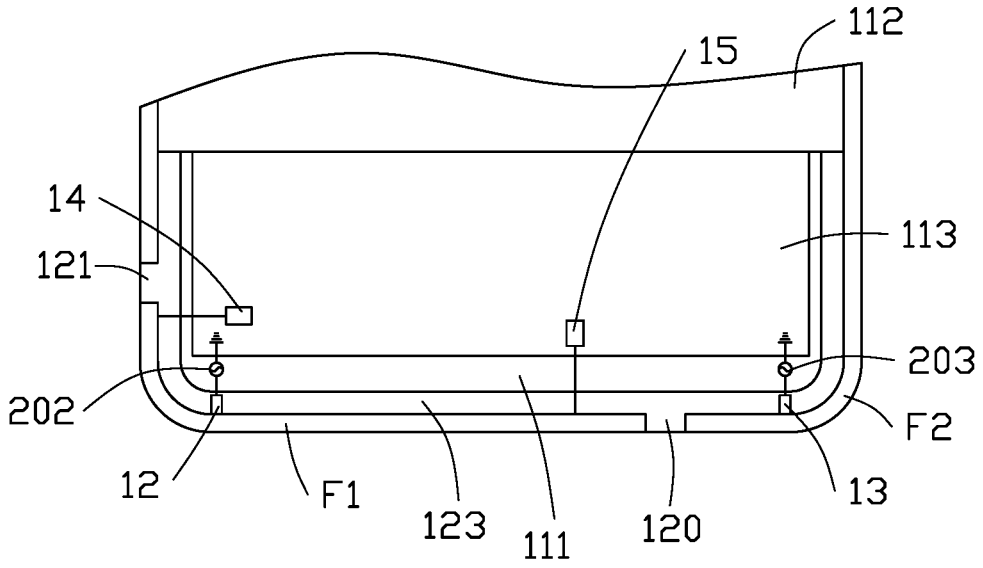
FIG. 4 is a circuit diagram of the antenna structure.

As illustrated in FIG. 4, the antenna structure 100 includes at least a frame, a first feed portion 12, a second feed portion 13, a first switch circuit 14, and a second switch circuit 15.

At least a part of the frame may be made of metal material. In at least one embodiment, such part of the frame may be the frame 110 of the wireless communication device 200. Referring to FIG. 1, the frame 110 includes at least a first portion 115, a second portion 116, and a third portion 117. In at least one embodiment, the first portion 115 may be a bottom end of the wireless communication device 200. That is, the first portion 115 may be a metal bottom end of the frame 110 of the wireless communication device 200, the antenna structure 100 constituting a lower antenna of the wireless communication device 200. The second portion 116 and the third portion 117 are positioned opposite to each other. The second portion 116 and the third portion 117 are each disposed at one end of the first portion 115 and are preferably disposed vertically. In at least one embodiment, a length of each of the second portion 116 and the third portion 117 is greater than a length of the first portion 115. The second portion 116 and the third portion 117 may be metal side frames of the wireless communication device 200.

The frame 110 defines at least one gap as hereinafter specified. In at least one embodiment, the frame 110 defines two gaps, namely a first gap 120 and a second gap 121. The first gap 120 is defined at the first portion 115. The second gap 121 is defined at the second portion 116. The first gap 120 is closer to the third portion 117 rather than it is to the second gap 121.

In at least one embodiment, at least two radiation portions are created by at least one of the gaps 120 and 121, cooperatively dividing the frame 110. Referring to FIG. 4, in at least one embodiment, the first gap 120 and the second gap 121 collectively divide the frame 110 into two radiation portions, namely a first radiation portion F1 and a second radiation portion F2. In at least one embodiment, the frame 110 between the first gap 120 and the second gap 121 forms the first radiation portion F1. The frame 110 between the first gap 120 and the third portion 117 forms the second radiation portion F2.

That is, the first radiation portion F1 is formed by the first portion 115 and at least a part of the second portion 116 and is arranged in a corner of the wireless communication device 200. Two opposite ends of the first radiation portion F1 are respectively connected to the first gap 120 and the second gap 121. Two opposite ends of the second radiation portion F2 are respectively connected to the first gap 120 and the third portion 117, and are further connected to the back board 111. An electronic length of the second radiation portion F2 is less than that of the first radiation portion F1.

In at least one embodiment, the frame 110 further defines a groove 123. The groove 123 may be substantially U-shaped and is communicated with the first gap 120 and the second gap 121, to separate and insulate the first radiation portion F1 and the second radiation portion F2 from the middle frame 113. That is, in at least one embodiment, the groove 123 may separate the radiation portions of the frame 110 (the first radiation portion F1 and the second radiation portion F2) from the back board 111. Furthermore, the groove 123 may also separate the radiation portions of the frame 110 from the ground plane 112, and portions other than the groove 123, the frame 110, the back board 111, and the ground plane 112 are connected.

In at least one embodiment, the first gap 120, the second gap 121, and the groove 123 are all filled with an insulating material (such as plastic, rubber, glass, wood, ceramic, etc., not limited to these).

In at least one embodiment, a width of the frame 110 may be about 1-2 mm. The first gap 120 and the second gap 121 may have the same width of about 1-2 mm. A width of the groove 123 may be less than or equal to twice the width of the first gap 120 and the second gap 121. The width of the groove 123 may be about 0.5-2 mm.

The first feed portion 12 is positioned in an inner side of the first radiation portion F1. In at least one embodiment, the first feed portion 12 is positioned in the clearance area 114. One end of the first feed portion 12 may be electrically connected to a first signal feed point 202 by means of an elastic sheet, a microstrip line, a strip line, or a coaxial cable. Another end of the first feed portion 12 is electrically connected to the first radiation portion F1, to feed current and signals to the first radiation portion F1. In at least one embodiment, the first feed portion 12 is closer to the second gap 121 than it is to the first gap 120.

The second feed portion 13 is positioned in the inner side of the second radiation portion F2. In at least one embodiment, the second feed portion 13 is positioned in the clearance area 114. One end of the second feed portion 13 may be electrically connected to a second signal feed point 203 by means of an elastic sheet, a microstrip line, a strip line, or a coaxial cable. Another end of the second feed portion 13 is electrically connected to the second radiation portion F2, to feed current and signals to the second radiation portion F2. In at least one embodiment, the second feed portion 13 is electrically connected to the first portion 115 of the second radiation portion F2, and is closer to the first feed portion 12 than it is to the first gap 120.

In at least one embodiment, a first end of the first switch circuit 14 is electrically connected to the first radiation portion F1. A second end of the first switch circuit 14 is electrically connected to the ground plane 112, i.e. grounded. In at least one embodiment, the first switch circuit 14 is closer to the second gap 121 than it is to the first feed portion 12. That is, in at least one embodiment, the first switch circuit 14 is arranged between the second gap 121 and the first feed portion 12. In detail, the first switch circuit 14 is electrically connected to an end position of the first radiation portion F1 close to the second gap 121. The first switch circuit 14 is configured to switch the first radiation portion F1 to the ground plane 112, or to de-ground the first radiation portion F1, or to switch the first radiation portion F1 to a different ground location (equivalent to switching to a component of different impedance), thereby effectively adjusting a bandwidth of the antenna structure 100, to achieve multi-frequency functions.

In at least one embodiment, the specific structure of the first switch circuit 14 may take various forms, for example, it may include a single switch, a multiple switch, a single switch with a matching component, or a multiple switch with a matching component.

Figure 5A:
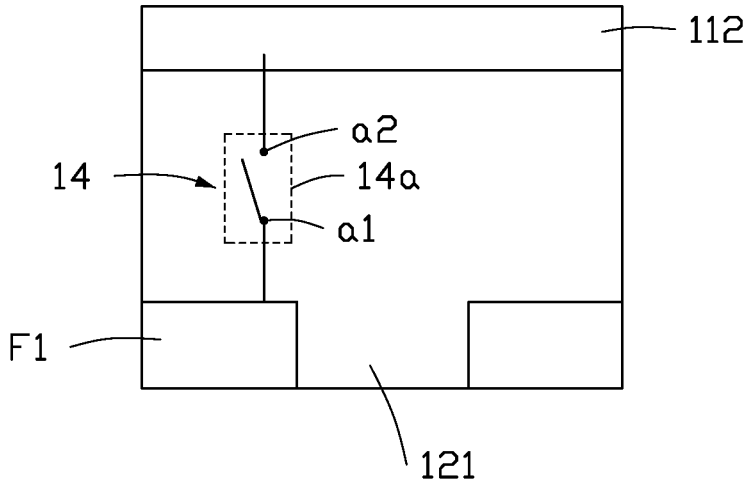
FIGS. 5A, 5B, 5C, and 5D are circuit diagrams of switching circuits of the antenna structure of FIG. 4.

Referring to FIG. 5A, in at least one embodiment, the first switch circuit 14 includes a single switch 14*a*. The single switch 14*a* includes a movable contact a1 and a static contact a2. The movable contact a1 is electrically connected to the first radiation portion F1. The static contact a2 of the single switch 14*a* is electrically connected to the ground plane 112. Therefore, by controlling the single switch 14*a* to be turned on or off, the first radiation portion F1 is electrically connected or disconnected from the ground plane 112. The first radiation portion F1 can also be controlled to be grounded or de-grounded, to achieve the functions of multiple frequencies.

Figure 5B:
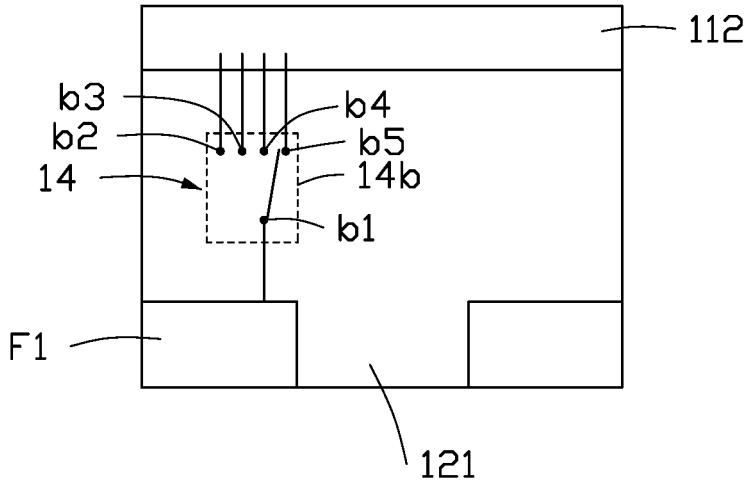

Referring to FIG. 5B, the first switch circuit 14 includes a multiplexing switch 14*b*. In at least one embodiment, the multiplexing switch 14*b* is a four-way switch. The multiplexing switch 14*b* includes a movable contact b1, a first static contact b2, a second static contact b3, a third static contact b4, and a fourth static contact b5. The movable contact b1 is electrically connected to the first radiation portion F1. The first static contact b2, the second static contact b3, the third static contact b4, and the fourth static contact b5 are each electrically connected to different parts of the ground plane 112. By controlling the switching of the movable contact b1, the movable contact b1 may be switched to the first static contact b2, the second static contact b3, the third static contact b4, or the fourth static contact b5. Therefore, the first radiation portion F1 may be electrically connected to different positions of the ground plane 112, thereby achieving multi-frequency functions.

Figure 5C:
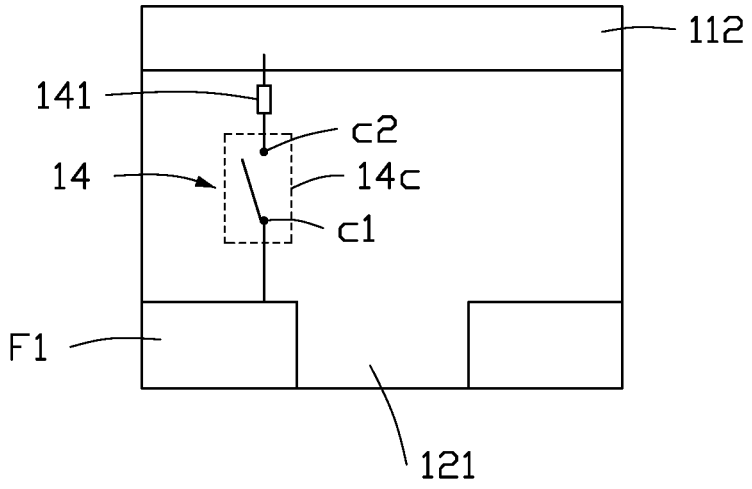

Referring to FIG. 5C, the first switch circuit 14 includes a single switch 14*c* and an impedance-matching component 141. The single switch 14*c* includes a movable contact c1 and a static contact c2. The movable contact c1 is electrically connected to the first radiation portion F1. The static contact c2 is electrically connected to the ground plane 112 through the impedance-matching component 141. The impedance-matching component 141 has a preset impedance. The impedance-matching component 141 may include an inductor, a capacitor, or a combination of an inductor and a capacitor.

Figure 5D:
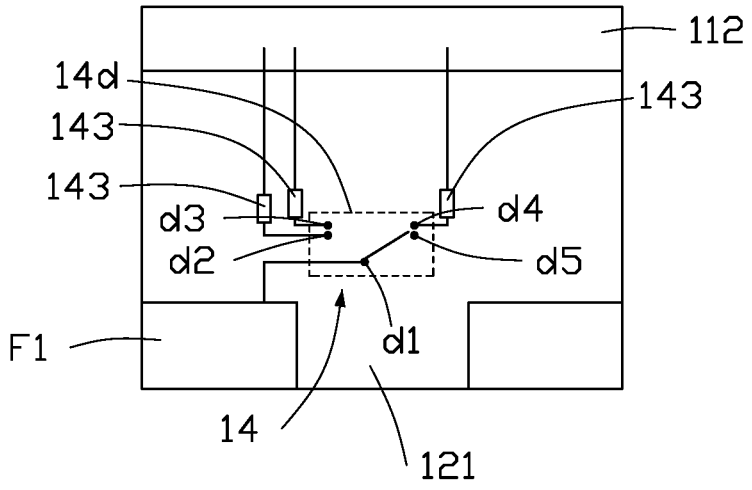

Referring to FIG. 5D, the first switch circuit 14 includes a multiplexing switch 14*d* and at least one impedance-matching component 143. In at least one embodiment, the multiplexing switch 14*d* is a four-way switch, and the first switch circuit 14 includes three impedance-matching components 143. The multiplexing switch 14*d* includes a movable contact d1, a first static contact d2, a second static contact d3, a third static contact d4, and a fourth static contact d5. The movable contact d1 is electrically connected to the first radiation portion F1. The first static contact d2, the second static contact d3, and the third static contact d4 are electrically connected to the ground plane 112 through corresponding impedance-matching components 143. The fourth static contact d5 is suspended. Each of the impedance-matching components 143 has a preset impedance, and the preset impedances of the impedance-matching components 143 may be the same or different. Each of the impedance-matching components 143 may include an inductor, a capacitor, or a combination of an inductor and a capacitor. The location whereby each of the impedance-matching components 143 may be electrically connected to the ground plane 112 may be the same or different.

By controlling the switching of the movable contact d1, the movable contact d1 may be switched to the first static contact d2, the second static contact d3, the third static contact d4, or the fourth static contact d5. Therefore, the first radiation portion F1 may be electrically connected to the ground plane 112 or disconnected from the ground plane 112 through different impedance-matching components 143, thereby achieving the functions of multiple frequencies.

In at least one embodiment, a first end of the second switch circuit 15 is electrically connected to the first radiation portion F1. A second end of the second switch circuit 15 is electrically connected to the ground plane 112, i.e. grounded. In at least one embodiment, the second switch circuit 15 is closer to the first gap 120 than it is to the first feed portion 12. That is, in at least one embodiment, the second switch circuit 15 is arranged between the first gap 120 and the first feed portion 12. In at least one embodiment, a circuit structure and a working principle of the second switch circuit 15 may be similar to that of the first switch circuit 14, as already described.

Figure 6:
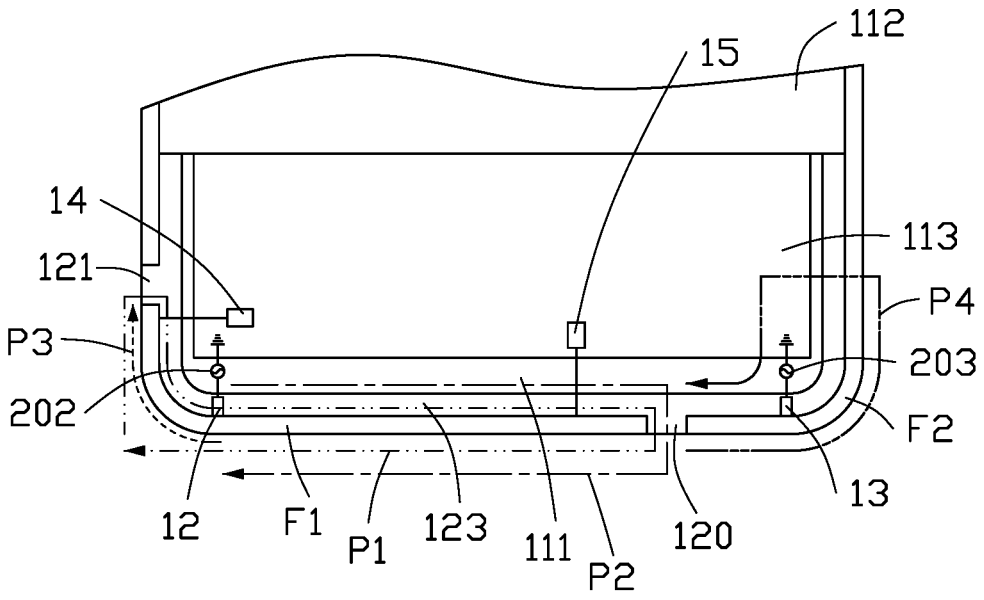
FIG. 6 is a current path distribution graph of the antenna structure of FIG. 4.

FIG. 6 illustrates a diagram of current paths of the antenna structure 100. The first radiation portion F1 may be a monopole antenna. When the first feed portion 12 supplies a current, the current flows through the first radiation portion F1, and towards the first gap 120 (path P1), to excite a first working mode and generate a radiation signal in a first radiation frequency band.

When the first feed portion 12 supplies a current, the current will flow through the first radiation portion F1, towards the first gap 120 and then the second gap 121, and further flows to the middle frame 113 and the back board 111 (path P2), to excite a second working mode and generate a radiation signal in a second radiation frequency band.

When the first feed portion 12 supplies a current, the current will flow through the first radiation portion F1, toward the second gap 121 (path P3), to excite a third working mode and generate a radiation signal in a third radiation frequency band.

In at least one embodiment, the second radiation portion F2 may be a loop antenna. When the second feed portion 13 supplies a current, the current also flows through the second radiation portion F2 toward the back board 111 and the middle frame 113 (path P4), to excite a fourth working mode and generate a radiation signal in a fourth radiation frequency band.

In at least one embodiment, the first working mode may be a Long Term Evolution Advanced (LTE-A) low frequency mode. The frequency of the first radiation frequency band may be 700-960 MHz. The second working mode may include an ultra-middle frequency (UMB) mode, an LTE-A middle frequency mode, and an LTE-A high frequency mode. The frequencies of the second radiation frequency band may include 1427-1518 MHz, 1710-2170 MHz, and 2300-2690 MHz. The third working mode may include an ultra-high frequency (UHB) mode, a 5G N78 mode, and a 5G N79 mode. The frequencies of the third radiation frequency band may include 3300-3800 MHz and 4400-5000 MHz. The fourth working mode may be an LTE-A middle frequency mode and an LTE-A high frequency mode. The frequencies of the fourth radiation frequency band may be 1710-2170 MHz and 2300-2690 MHz.

In at least one embodiment, the first radiation portion F1 functions as an LTE-A low-frequency, middle-frequency, high-frequency, ultra-middle frequency, ultra-high frequency, 5G N78, and 5G N79 antenna. The second radiation portion F2 forms an LTE-A middle-frequency, high-frequency antenna. In at least one embodiment, the first radiation portion F1 and the second radiation portion F2 include at least one common radiation frequency band, that is, the first radiation portion F1 and the second radiation portion F2 include at least one overlapping radiation frequency band. For instance, the first radiation portion F1 and the second radiation portion F2 both may generate radiation signal in radiation frequency bands of 1710-2170 MHz and 2300-2690 MHz. Thus, the wireless communication device 200 may function as multiple input multiple output (MIMO). For instance, when the wireless communication device 200 arranges a corresponding upper antenna on a top thereof, which allows the wireless communication device 200 to support 4*4 MIMO.

In at least one embodiment, the first radiation portion F1 and the second radiation portion F2 may be made of materials such as iron, copper foil, or a conductor of laser direct structuring (LDS) process.

In at least one embodiment, in handheld electronic devices, optimizing detuned antennas may have maximum radiation efficiency in multiple frequency bands, which may mainly tune an antenna efficiency characteristic and cause the frequency bands of the antenna being efficiently shifted. Thus, in at least one embodiment, the first feed portion 12 and/or the second feed portion 13 may be arranged with capacitors, inductors, or combinations thereof, that is, the first feed portion 12 and/or the second feed portion 13 may be replaced with capacitors, inductors, or combinations thereof. In addition, by connecting one end of the first feed portion 12 and/or the second feed portion 13 to the system grounding plane, i.e. grounded, and another end of the first feed portion 12 and/or the second feed portion 13 connecting to the first radiation portion F1 and/or the second radiation portion F2. Thereby the antenna structure 100 has a good detuned performance and is strongly isolated.

Figure 7:
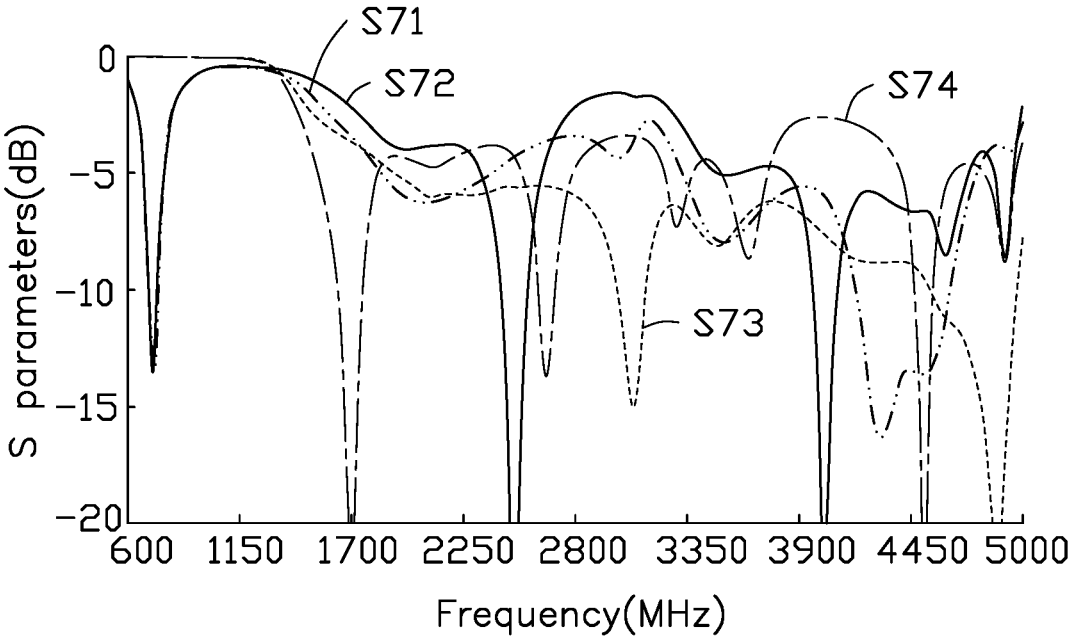
FIG. 7 is a scattering parameter graph when the antenna structure of FIG. 1 is in operation.

FIG. 7 is a graph of scattering parameters (S parameters) of the antenna structure 100. Curve S71 may be an S11 value of the first radiation portion F1 when the antenna structure 100 works in an un-detuned design. Curve S72 may be an S11 value of the first radiation portion F1 when the antenna structure 100 works in a detuned design. Curve S73 may be an S11 value of the second radiation portion F2 when the antenna structure 100 works in the non-detuned design. Curve S74 may be an S11 value of the second radiation portion F2 when the antenna structure 100 works in the detuned design.

Figure 8:
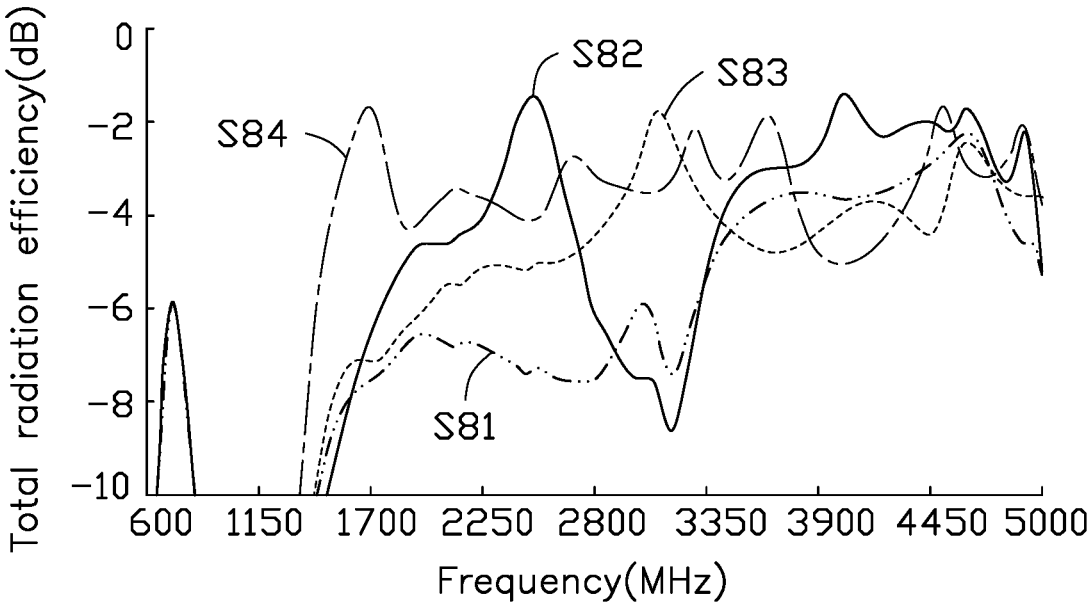
FIG. 8 is a total radiation efficiency graph when the antenna structure of FIG. 1 is in operation.

FIG. 8 is a graph of total radiation efficiency of the antenna structure 100. Curve S81 may be a total radiation efficiency of the first radiation portion F1 when the antenna structure 100 works in an un-detuned design. Curve S82 may be a total radiation efficiency of the first radiation portion F1 when the antenna structure 100 works in a detuned design. Curve S83 may be a total radiation efficiency of the second radiation portion F2 when the antenna structure 100 works in the non-detuned design. Curve S84 may be a total radiation efficiency of the second radiation portion F2 when the antenna structure 100 works in the detuned design.

In at least one embodiment, as shown in FIGS. 7 and 8, when the first feed portion 12 and/or the second feed portion 13 are/is replaced with capacitors, inductors, or combinations thereof, the antenna structure 100 has a good detuned performance and strong isolation. In addition, the antenna structure 100 with high isolation may efficiently improve a middle-frequency and high-frequency bandwidth and antenna efficiency, meanwhile having a MIMO characteristic. The frequency bands of the antenna structure 100 may cover LTE-A low-frequency, middle-frequency, high-frequency, ultra-middle frequency, ultra-high frequency, 5G N78, and 5G N79 frequency bands, which may greatly improve a frequency bandwidth and antenna efficiency and cover global frequency bands, and be beneficial to a carrier aggregation application (CA) of LTE-A.

That is, the antenna structure 100 may generate various working modes, such as low-frequency mode, middle-frequency mode, high-frequency mode, ultra-middle frequency mode, ultra-high frequency mode, 5G N78 frequency mode, and 5G N79 frequency mode, communication bands as commonly used in the world are covered. Specifically, the antenna structure 100 may cover GSM850/900/WCDMA Band5/Band8/Band13/Band17/Band20 at low frequencies, GSM 1800/1900/WCDMA 2100 (1710-2170 MHz) at middle frequencies, LTE-A Band1, Band40, Band41 (2300-2690 MHz) at high frequencies, middle-frequency bands of 1427-1518 MHz, ultra-middle frequency bands of 3400-3800 MHz, and 5G frequency bands including N78 (3300-3800 MHz) and N79 (4400-5000 MHz). The frequency bands of the antenna structure 100 may be applied to the operation of GSM Qual-band, UMTS Band I/WV/VIII frequency bands, and LTE 850/900/1800/1900/2100/2300/2500 frequency bands, as are commonly used worldwide.

Furthermore, the first gap 120 and the second gap 121 of the antenna structure 100 are set on the frame 110, and not on the back board 111, which is an integrated metal piece, thus the back board 111 is a whole metal structure. That is, there is not any slot, break line, gap, or groove between the back board 111 and the frame 110, the back board 111 does not define any slot, break line, gap, or groove dividing the back board 111, which maintains a completeness and appearance of the back board 111.

The antenna structure 100 sets at least one gap (such as the first gap 120 and the second gap 121) on the frame 110 to create at least two radiation portions which utilize the frame 110. The antenna structure 100 further includes the first switch circuit 14 and the second switch circuit 15. Therefore, it may cover multiple frequency bands, such as, low frequency, middle frequency, high frequency, middle-frequency, high-frequency, ultra-middle frequency, ultra-high frequency, 5G N78 frequency, and 5G N79 frequency through different switching methods, and render radiation abilities of the antenna structure 100 more effective in broadband ranges compared to a general metal backing. The antenna structure 100 increases the frequency bandwidth and gives better antenna efficiency, covering the requirements of global frequency band applications and supporting CA, meanwhile having the MIMO characteristic. Furthermore, the antenna structure 100 achieves good detuned performance and strong isolation. In addition, the antenna structure 100 has a full screen at the front, and the antenna structure 100 still has good performance in the less-than-optimal environment of the back board 111, the frame 110, and a large area of grounded metal around it.

Figure 9:
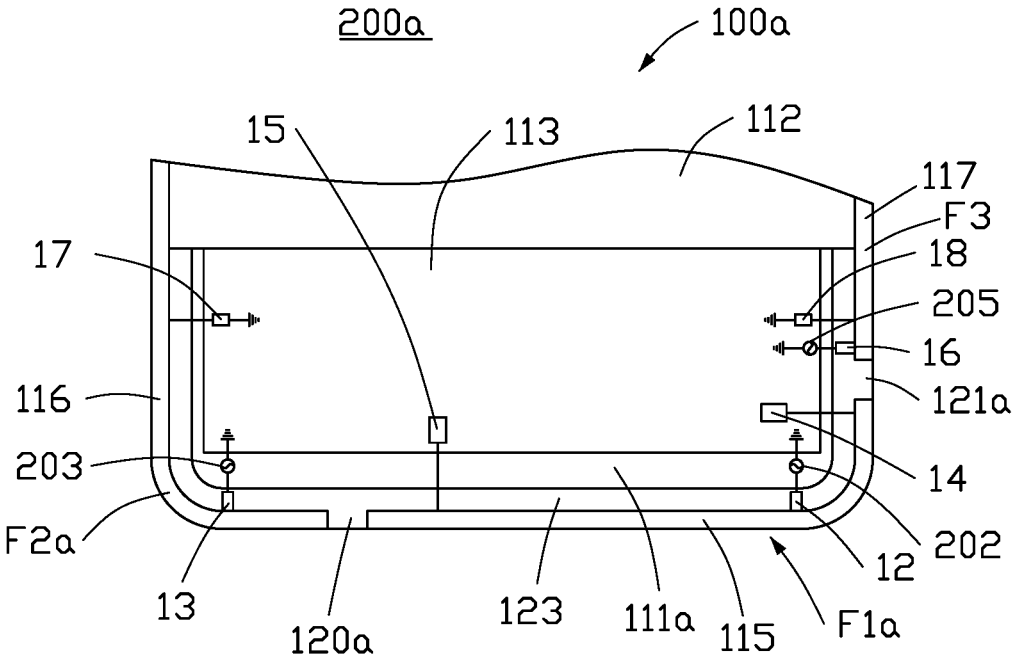
FIG. 9 is a schematic diagram of a second embodiment of the antenna structure.

FIG. 9 illustrates a second embodiment of a wireless communication device 200*a* using an antenna structure 100*a*. The antenna structure 100*a* may be used in the wireless communication device 200*a* for transmitting and receiving radio waves, to exchange wireless signals.

The antenna structure 100*a* includes at least the frame 110, a back board 111*a*, the ground plane 112, the middle frame 113, the first feed portion 12, the second feed portion 13, the first switch circuit 14, and the second switch circuit 15. The frame 110 defines two gaps, namely a first gap 120*a* and a second gap 121*a*. The first gap 120*a* and the second gap 121*a* collectively divide the frame 110 into two radiation portions, namely a first radiation portion F1*a* and a second radiation portion F2*a*.

In at least one embodiment, at least one difference between the antenna structure 100*a* and the antenna structure 100 may include the back board 111*a* being made of insulation materials, such as glass.

In at least one embodiment, at least one difference between the antenna structure 100*a* and the antenna structure 100 may further include positions of the first gap 120*a* and the second gap 121*a* on the frame 110 different from the positions of the first gap 120 and the second gap 121 on the frame 110. Specially, the first gap 120*a* is defined at the first portion 115 and is close to the second portion 116. The second gap 121 is defined at the third portion 117. Thus, the first radiation portion F1*a* is formed by the first portion 115 and at least a part of the third portion 117. Two opposite ends of the first radiation portion F1*a* are respectively connected to the first gap 120*a* and the second gap 121*a*. The second radiation portion F2*a* is formed by the first portion 115 and at least a part of the second portion 116. One end of the second radiation portion F2*a* is connected to the first gap 120*a*, another end of the second radiation portion F2*a* is connected to the second portion 116 and the ground plane 112.

In at least one embodiment, at least one difference between the antenna structure 100*a* and the antenna structure 100 may further include: the antenna structure 100*a* further includes a third feed portion 16. The first gap 120*a* and the second gap 121*a* collectively divide the frame 110 to form a third radiation portion F3. The third radiation portion F3 is formed by ends of the third portion 117 corresponding to the second gap 121*a* and the groove 123. The third radiation portion F3 and the second radiation portion F2*a* are on opposite sides of the first radiation portion F1*a*. One end of the third radiation portion F3 is connected the second gap 121*a*, another end of the third radiation portion F3 is connected the system ground plane, i.e. grounded.

The third feed portion 16 is positioned in an inner side of the third radiation portion F3. In at least one embodiment, the third feed portion 16 is positioned in the clearance area 114. One end of the third feed portion 16 may be electrically connected to a third signal feed point 205 by means of an elastic sheet, a microstrip line, a strip line, or a coaxial cable. Another end of the third feed portion 16 is electrically connected to the third radiation portion F3. In at least one embodiment, the third feed portion 16 is electrically connected to the third 117 of the third radiation portion F3, the third feed portion 16 and the first switch circuit 14 being on opposite sides of the second gap 121*a*.

Figure 10:
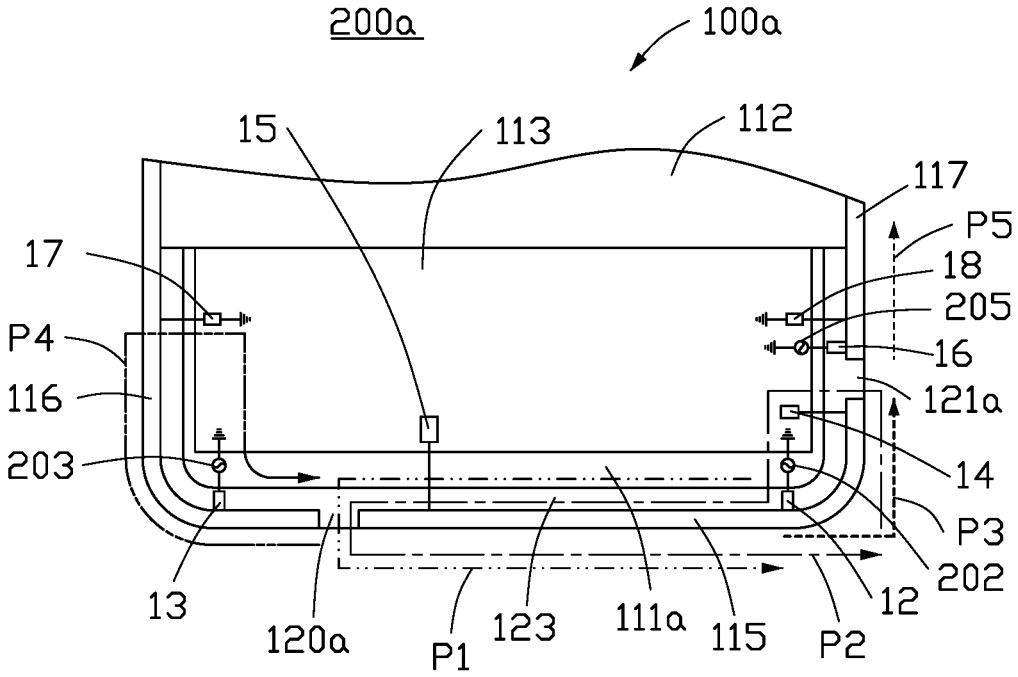
FIG. 10 is a current path distribution graph of the antenna structure of FIG. 9.

Referring to FIG. 10, in at least one embodiment, a working method and working frequency bands of the first radiation portion F1*a* and the second radiation portion F2*a* may be the same as those of the first radiation portion F1 and the second radiation portion F2 of the antenna structure 100. That is, the first radiation portion F1*a* may work in the LTE-A low-frequency, middle-frequency, high-frequency, ultra-middle frequency, ultra-high frequency, 5G N78, and 5G N79 frequency bands. The second radiation portion F2*a* may work in the LTE-A middle-frequency and high-frequency bands. When the third feed portion 16 supplies a current, the current flows through the third radiation portion F3 towards the back board 111, the ground plane 112, and the middle frame 113 (path P5), to excite a third working mode and generate a radiation signal in a third radiation frequency band.

In at least one embodiment, at least one difference between the antenna structure 100*a* and the antenna structure 100 may further include: the antenna structure 100*a* further includes a ground portion 17 and an adjusting portion 18. The ground portion 17 is positioned in an inner side of the second radiation portion F2*a*. In at least one embodiment, the ground portion 17 is positioned in the clearance area 114. One end of the ground portion 17 may be connected to the system ground plane by means of an elastic sheet, a microstrip line, a strip line, or a coaxial cable, i.e. grounded. Another end of the ground portion 17 is electrically connected to the second radiation portion F2*a* for grounding the second radiation portion F2*a*.

In at least one embodiment, the ground portion 17 is connected to the second radiation portion F2*a* corresponding to the end of the second portion 116 corresponding to the groove 123. That is, the ground portion 17 is connected to an end of the second radiation portion F2*a* away from the first gap 120*a*.

In at least one embodiment, the adjusting portion 18 is positioned in an inner side of the third radiation portion F3. In at least one embodiment, the adjusting portion 18 is positioned in the clearance area 114. One end of the adjusting portion 18 may be connected to the third radiation portion F3 by means of an elastic sheet, a microstrip line, a strip line, or a coaxial cable. Another end of the adjusting portion 18 may be connected to the system ground plane, i.e. grounded. In at least one embodiment, the adjusting portion 18 may be a middle/high band conditioner (MHC), which may be inductors, capacitors, or a combination of inductors and capacitors. The adjusting portion 18 is configured to adjust the middle and high frequency band of the antenna structure 100*a* and improve the bandwidth and antenna efficiency. In at least one embodiment, the adjusting portion 18 is closer to the second gap 121*a* than it is to the third feed portion 16.

In at least one embodiment, the positions of the ground portion 17 and adjusting portion 18 connecting to the system ground plane may be adjusted according to the frequency needed. For example, if the connecting positions are closer to the second feed portion 13 and/or the third feed portion 16, the frequencies of the antenna structure 100*a* are shifted toward a higher frequency; on the contrary, if the connecting positions are further away from the second feed portion 13 and/or the third feed portion 16, the frequencies of the antenna structure 100*a* are shifted toward a lower frequency.

Figure 11:
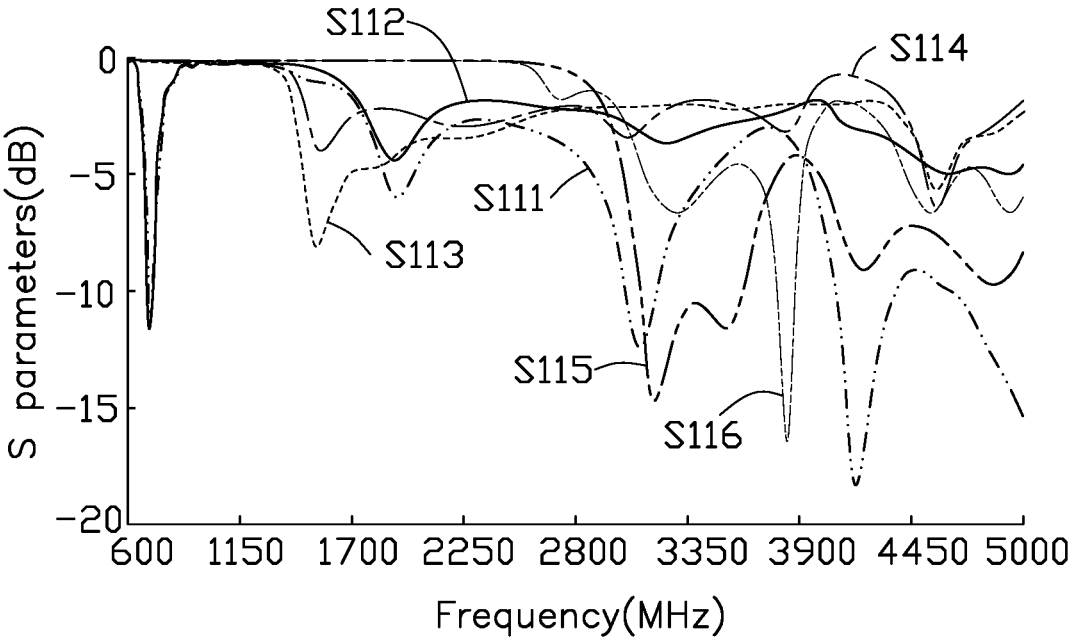
FIG. 11 is a scattering parameter graph when the antenna structure of FIG. 9 is in operation.

FIG. 11 is a graph of scattering parameters (S parameters) of the antenna structure 100*a*. Curve S111 may be an S11 value of the first radiation portion F1*a* when the antenna structure 100*a* works in an non-detuned design. Curve S112 may be an S11 value of the first radiation portion F1*a* when the antenna structure 100*a* works in a detuned design. Curve S113 may be an S11 value of the second radiation portion F2*a* when the antenna structure 100*a* works in the non-detuned design. Curve S114 may be an S11 value of the second radiation portion F2*a* when the antenna structure 100*a* works in the detuned design. Curve S115 may be an S11 value of the third radiation portion F3 when the antenna structure 100*a* works in the non-detuned design. Curve S116 may be an S11 value of the third radiation portion F3 when the antenna structure 100*a* works in the detuned design.

Figure 12:
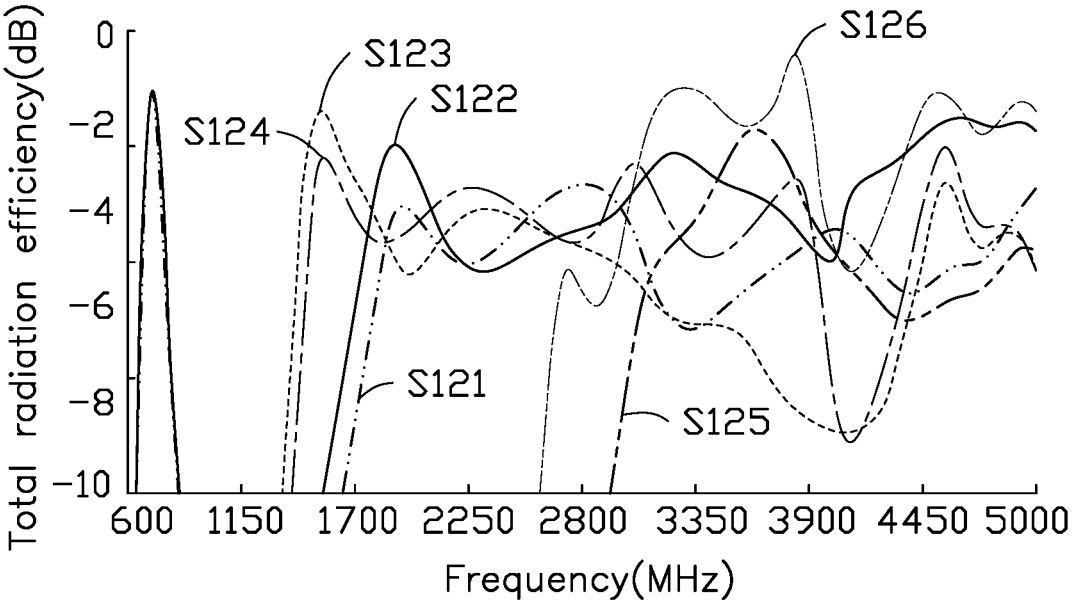
FIG. 12 is a total radiation efficiency graph when the antenna structure of FIG. 9 is in operation.

FIG. 12 is a graph of total radiation efficiency of the antenna structure 100*a*. Curve S121 may be a total radiation efficiency of the first radiation portion F1*a* when the antenna structure 100*a* works in a non-detuned design. Curve S122 may be a total radiation efficiency of the first radiation portion F1*a* when the antenna structure 100*a* works in a detuned design. Curve S123 may be a total radiation efficiency of the second radiation portion F2*a* when the antenna structure 100*a* works in the non-detuned design. Curve S124 may be a total radiation efficiency of the second radiation portion F2*a* when the antenna structure 100*a* works in the detuned design. Curve S125 may be a total radiation efficiency of the third radiation portion F3 when the antenna structure 100*a* works in the non-detuned design. Curve S126 may be a total radiation efficiency of the third radiation portion F3 when the antenna structure 100*a* works in the detuned design.

In at least one embodiment, similar to the antenna structure 100, the antenna structure 100*a* defines a plurality of gaps, such as the first gap 120*a* and the second gap 121*a*, to form at least three independent radiation portions. The first radiation portion F1*a* may generate various working modes, such as LTE-A low-frequency mode, middle-frequency mode, high-frequency mode, ultra-middle frequency mode, ultra-high frequency mode, 5G N78 frequency mode, and 5G N79 frequency mode (covering frequency bands of 700-960 MHz, 1427-1518 MHz, 1710-2170 MHz, 2300-2690 MHz, 3300-3800 MHz, and 4400-5000 MHz). The second radiation portion F2*a* may generate various working modes, such as LTE-A middle-frequency mode and high-frequency mode (covering frequency bands of 1710-2170 MHz and 2300-2690 MHz). The third radiation portion F3 may generate various working modes, such as ultra-high frequency mode, 5G N78 frequency mode, and 5G N79 frequency mode (covering frequency bands of 3300-3800 MHz and 4400-5000 MHz). Thereby, the frequency bandwidth and antenna efficiency of the antenna structure 100*a* is improved, meanwhile having MIMO characteristic.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure applied in a wireless communication device, the antenna structure comprising:

a frame, the frame at least partially made of metal materials, wherein the frame defines at least a first gap and a second gap, the first gap and the second gap collectively divide the frame into a first radiation portion and a second radiation portion;

a first feed portion, the first feed portion electrically connected to the first radiation portion and a first signal feed point for feeding currents and signals to the first radiation portion; and a second feed portion, the second feed portion electrically connected to the second radiation portion and a second signal feed point for feeding currents and signals to the second radiation portion;

wherein when the first radiation portion and the second radiation portion supply currents, respectively, the first radiation portion and the second radiation portion generate radiation signals in at least one same frequency band, the at least one same frequency band is an LTE-A middle and high frequency band.

2. The antenna structure of claim 1, wherein when the first radiation portion supplies the current, the first radiation portion excites LTE-A low-frequency mode, middle-frequency mode, high-frequency mode, ultra-middle frequency mode, ultra-high frequency mode, 5G N78 mode, and 5G N79 mode; when the second radiation portion supplies the current, the second radiation portion excites LTE-A middle-frequency mode and high-frequency mode.

3. The antenna structure of claim 1, wherein the first gap and the second gap further collectively divide the frame into a third radiation portion, the antenna structure further comprises:

a third feed portion, the third feed portion is electrically connected to the third radiation portion, and a third signal feed point for feeding currents and signals to the third radiation portion, wherein when the third radiation portion supplies the current, the third radiation portion excites ultra-high frequency mode, 5G N78 mode, and 5G N79 mode.

4. The antenna structure of claim 3, wherein the frame comprises at least a first portion, a second portion, and a third portion, the second portion and the third portion are each disposed at one end of the first portion, a length of each of the second portion and the third portion is greater than a length of the first portion;

the first gap is defined on the first portion, the second gap is defined on the second portion or the third portion, a portion of the frame between the first gap and the second gap forms the first radiation portion, the second radiation portion and the third radiation portion are spaced arranged on opposite ends of the first radiation portion, one end of the second radiation portion is connected to the first gap, another end of the second radiation portion is grounded; and one end of the third radiation portion is connected to the second gap, another end of the third radiation portion is grounded.

5. The antenna structure of claim 1, further comprising a first switch circuit and a second switch circuit, wherein the first switch circuit and the second switch circuit are arranged on opposite sides of the first feed portion, one end of each of the first switch circuit and the second switch circuit is electrically connected to the first radiation portion, another end of each of the first switch circuit and the second switch circuit is grounded, the first switch circuit and the second switch circuit are configured to adjust a radiation frequency of the first radiation portion.

6. The antenna structure of claim 1, further comprising a ground portion, wherein one end of the ground portion is electrically connected to an end of the second radiation portion away from the first gap, another end of the ground portion is grounded, a radiation frequency of the second radiation portion is adjustable through adjusting a position of the ground portion.

7. The antenna structure of claim 3, further comprising an adjusting portion, wherein the adjusting portion is a middle/high band conditioner (MHC), one end of the adjusting portion is electrically connected to the third radiation portion, another end of the adjusting portion is grounded, the adjusting portion is configured to adjust a middle frequency band and a high frequency band of the antenna structure.

8. The antenna structure of claim 1, wherein the frame further defines a groove, the groove is communicated with the first gap and the second gap.

9. A wireless communication device, comprising:

an antenna structure comprising:

a frame, the frame at least partially made of metal materials, wherein the frame defines at least a first gap and a second gap, the first gap and the second gap collectively divide the frame into a first radiation portion and a second radiation portion;

a first feed portion, the first feed portion electrically connected to the first radiation portion and a first signal feed point for feeding currents and signals to the first radiation portion; and a second feed portion, the second feed portion electrically connected to the second radiation portion and a second signal feed point for feeding currents and signals to the second radiation portion;

wherein when the first radiation portion and the second radiation portion supply currents, respectively, the first radiation portion and the second radiation portion generate radiation signals in at least one same frequency band, the at least one same frequency band is an LTE-A middle and high frequency band.

10. The wireless communication device of claim 9, wherein when the first radiation portion supplies the current, the first radiation portion excites LTE-A low-frequency mode, middle-frequency mode, high-frequency mode, ultra-middle frequency mode, ultra-high frequency mode, 5G N78 mode, and 5G N79 mode; when the second radiation portion supplies the current, the second radiation portion excites LTE-A middle-frequency mode and high-frequency mode.

11. The wireless communication device of claim 9, wherein the first gap and the second gap further collectively divide the frame into a third radiation portion, the antenna structure further comprises a third feed portion, the third feed portion is electrically connected to the third radiation portion, and a third signal feed point for feeding currents and signals to the third radiation portion, wherein when the third radiation portion supplies the current, the third radiation portion excites ultra-high frequency mode, 5G N78 mode, and 5G N79 mode.

12. The wireless communication device of claim 11, wherein the frame comprises at least a first portion, a second portion, and a third portion, the second portion and the third portion are each disposed at one end of the first portion, a length of each of the second portion and the third portion is greater than a length of the first portion; the first gap is defined on the first portion, the second gap is defined on the second portion or the third portion, a portion of the frame between the first gap and the second gap forms the first radiation portion, the second radiation portion and the third radiation portion are spaced arranged on opposite ends of the first radiation portion, one end of the second radiation portion is connected to the first gap, another end of the second radiation portion is grounded; and one end of the third radiation portion is connected to the second gap, another end of the third radiation portion is grounded.

13. The wireless communication device of claim 9, further comprising a first switch circuit and a second switch circuit, wherein the first switch circuit and the second switch circuit are arranged on opposite sides of the first feed portion, one end of each of the first switch circuit and the second switch circuit is electrically connected to the first radiation portion, another end of each of the first switch circuit and the second switch circuit is grounded, the first switch circuit and the second switch circuit are configured to adjust the radiation frequency of the first radiation portion.

14. The wireless communication device of claim 9, further comprising a ground portion, wherein one end of the ground portion is electrically connected to an end of the second radiation portion away from the first gap, another end of the ground portion is grounded, a radiation frequency of the second radiation portion is adjustable through adjusting a position of the ground portion.

15. The wireless communication device of claim 11, further comprising an adjusting portion, wherein the adjusting portion is a middle/high band conditioner (WIC), one end of the adjusting portion is electrically connected to the third radiation portion, another end of the adjusting portion is grounded, the adjusting portion is configured to adjust a middle frequency band and a high frequency band of the antenna structure.

16. The wireless communication device of claim 9, wherein the frame further defines a groove, the groove is communicated with the first gap and the second gap.

17. The wireless communication device of claim 9, further comprising a display unit and a back board, wherein the display unit is received in an opening defined on a side of the frame, the display unit is a full screen display; the back board is an integrated metal piece, the back board is positioned at a periphery of the frame without any gaps, slots, break lines, and grooves.

* * * * *